US009534433B2

(12) United States Patent
Elkasevic et al.

(10) Patent No.: US 9,534,433 B2
(45) Date of Patent: Jan. 3, 2017

(54) REMOVABLE SIDE HINGE FOR APPLIANCE

(75) Inventors: Suad Elkasevic, Winterville, NC (US); Joseph Geiger, Trent Woods, NC (US); Charles Weimer, New Bern, NC (US); Philipp Wieser, Piding Bayern (DE)

(73) Assignee: BSH Home Appliances Corporation, Irvine, CA (US)

( * ) Notice: Subject to any disclaimer, the term of this patent is extended or adjusted under 35 U.S.C. 154(b) by 861 days.

(21) Appl. No.: 13/307,092

(22) Filed: Nov. 30, 2011

(65) Prior Publication Data

US 2013/0134853 A1 May 30, 2013

(51) Int. Cl.

| | |
|---|---|
| ***A47B 49/00*** | (2006.01) |
| ***E05D 11/10*** | (2006.01) |
| ***E05D 3/02*** | (2006.01) |
| ***E05D 7/04*** | (2006.01) |
| ***E05D 7/081*** | (2006.01) |
| *E05D 3/10* | (2006.01) |
| *E05D 3/18* | (2006.01) |

(52) U.S. Cl.

CPC ..... *E05D 11/10* (2013.01); *E05D 3/022* (2013.01); *E05D 7/04* (2013.01); *E05D 7/081* (2013.01); *E05D 3/10* (2013.01); *E05D 3/18* (2013.01); *E05Y 2800/744* (2013.01); *E05Y 2900/308* (2013.01); *Y10T 16/54* (2015.01); *Y10T 16/5406* (2015.01); *Y10T 16/5407* (2015.01)

(58) Field of Classification Search

CPC ..... E05D 11/10; E05D 3/022; E05D 7/04; E05D 7/081

USPC ..... 312/326–329, 405, 409; 49/381, 396; 16/240, 249, 384, 265

See application file for complete search history.

(56) References Cited

U.S. PATENT DOCUMENTS

| | | | | |
|---|---|---|---|---|
| 1,633,916 | A * | 6/1927 | Zoufal | 16/384 |
| 2,111,840 | A * | 3/1938 | Chrisman | 16/384 |
| 2,795,472 | A * | 6/1957 | Sutherland | 312/400 |
| 2,885,722 | A * | 5/1959 | Halliday | 16/237 |
| 2,973,547 | A * | 3/1961 | Heyer | 16/252 |
| 3,045,663 | A * | 7/1962 | McDonnold | 126/190 |
| 3,507,074 | A | 4/1970 | Gallegos | |
| 3,710,416 | A * | 1/1973 | Phelps | 16/390 |
| 3,906,670 | A * | 9/1975 | Burton | 49/381 |
| 5,375,297 | A * | 12/1994 | Lautenschlager et al. | 16/249 |
| 6,141,829 | A | 11/2000 | Boyer | |
| 6,438,800 | B1 | 8/2002 | Narang et al. | |
| 2004/0034966 | A1* | 2/2004 | Wegman | 16/254 |
| 2004/0093692 | A1* | 5/2004 | Cude et al. | 16/350 |

(Continued)

*Primary Examiner* — Daniel J Troy
*Assistant Examiner* — Timothy M Ayres
(74) *Attorney, Agent, or Firm* — Michael E. Tschupp; Andre Pallapies

(57) ABSTRACT

A hinge system for mounting a door to an appliance has an upper hinge bracket having an upper hinge swing element configured to engage a door upper swing element fixed to the door, the engagement of the upper hinge swing element and the door upper swing element allowing the door to swing about a vertical axis between an open position and a closed position, and an upper hinge pivot limiting element configured to engage a frame pivot limiting element fixed to the appliance; a lower hinge bracket having a lower hinge swing element configured to engage a door lower swing element, and a system pivot element configured to engage a frame pivot element such that the upper hinge bracket, the lower hinge bracket, and the door are pivotable about a horizontal axis as a unit relative to the appliance while still being attached to the appliance.

22 Claims, 7 Drawing Sheets

(56) References Cited

U.S. PATENT DOCUMENTS

2008/0127565 A1 6/2008 Taylor

* cited by examiner

REMOVABLE SIDE HINGE FOR APPLIANCE

FIELD OF THE INVENTION

The invention is directed to a hinge system for a side swing door. More particularly, the invention is directed to a hinge system that allows a side swing door to be tilted for safe removal of the door from an appliance.

An example of an application for the invention is a hinge system that attaches a side swing door to a domestic oven. By allowing the top of the door to pivot about a horizontal axis away from the oven while limiting how far the door pivots, the door can be pivoted far enough to remove a top hinge pin and permit safe removal of the door.

BACKGROUND OF THE INVENTION

Some domestic appliances, such as built in ovens, have one or more doors that each swing sideways about a vertical axis. Particular side swing doors have hinges that permit the door to swing about the vertical axis between a closed position and an open position. In some of these built-in ovens, a control panel is positioned above the door in close proximity to the top of the door. Such an arrangement can make it difficult or impossible to remove a door from the oven without removing the oven from the cabinet into which it is built. In the built-in arrangement, it is often not possible to access the hinges to remove the hinge pins. As a result, the entire oven usually needs to be at least partially removed from the cabinet to provide access to the hinge pins. Removing the oven, even partially, from the cabinet can be difficult and dangerous due to the large size and weight of some ovens.

As a solution to the above problem, embodiments of the invention provide a hinge system that allows the side swing door of an appliance to be removed from the appliance without removing the appliance from the cabinet.

SUMMARY

The invention recognizes that it is desirable to provide a hinge system that permits the top of the door to be pivoted away from the appliance, but only by a limited amount, so that the upper hinge pin can be removed. By limiting the extent of the pivoting, the door can be safely detached from the oven without the door falling off of the oven.

With a built-in oven that has a control panel positioned above and in close proximity to the top of a side swinging door, it can be difficult, or even impossible, to remove the door without at least partially removing the oven from the cabinet or wall. Hinges in accordance with the invention allow the top of the door to be pivoted down away from the oven body while both the top and the bottom of the door remain attached to the oven body. Particular embodiments also provide a retention mechanism that allows the top of the door to pivot down only a certain amount so that the door cannot fall and become detached from the oven body. At this maximum pivoting position, the hinge pin of the top hinge can then be removed while the door is safely supported by the technician who is removing the door.

Particular embodiments of the invention are directed to a hinge system for mounting a side swing door of a domestic kitchen appliance to a frame of the domestic kitchen appliance. The system includes an upper hinge bracket having an upper hinge swing element configured to engage a door upper swing element fixed to the door of the domestic kitchen appliance, the engagement of the upper hinge swing element and the door upper swing element allowing the door to swing about a vertical axis between an open position and a closed position, and an upper hinge pivot limiting element configured to engage a frame pivot limiting element fixed to the frame of the domestic home appliance; a lower hinge bracket having a lower hinge swing element configured to engage a door lower swing element, the engagement of the lower hinge swing element and the door lower swing element allowing the door to swing about the vertical axis between the open position and the closed position, and a system pivot element configured to engage a frame pivot element such that the upper hinge bracket, the lower hinge bracket, and the door are pivotable about a horizontal axis as a unit relative to the frame of the domestic kitchen appliance between an appliance operational position and a door removal position; and an operational position holding element attached to the upper hinge bracket or the lower hinge bracket, the operational position holding element configured to releasably hold the door in the appliance operational position. The appliance operational position is a position of upper hinge bracket, the lower hinge bracket, and the door at which the domestic kitchen appliance can be operated, and the upper hinge bracket and the lower hinge bracket are configured to keep the door attached to the frame of the domestic kitchen appliance when the upper hinge bracket, the lower hinge bracket and the door are in the door removal position.

Other embodiments of the invention are directed to domestic kitchen appliance having a cavity for receiving food to be processed by the domestic kitchen appliance. The domestic kitchen appliance includes a frame having a frame pivot limiting element and a frame pivot element; a side swing door for selectively opening or closing the cavity, the door having a door upper swing element and a door lower swing element; a hinge system mounting the door to the frame of the domestic kitchen appliance, the hinge system having an upper hinge bracket having an upper hinge swing element engaging the door upper swing element, the engagement of the upper hinge swing element and the door upper swing element allowing the door to swing about a vertical axis between an open position and a closed position, and an upper hinge pivot limiting element engaging the frame pivot limiting element; a lower hinge bracket having a lower hinge swing element engaging the door lower swing element, the engagement of the lower hinge swing element and the door lower swing element allowing the door to swing about the vertical axis between the open position and the closed position, and a system pivot element engaging the frame pivot element such that the upper hinge bracket, the lower hinge bracket, and the door are pivotable about a horizontal axis as a unit relative to the frame of the domestic kitchen appliance between an appliance operational position and a door removal position; and an operational position holding element attached to the upper hinge bracket or the lower hinge bracket, the operational position holding element releasably holding the door in the appliance operational position. The appliance operational position is a position of upper hinge bracket, the lower hinge bracket, and the door at which the domestic kitchen appliance can be operated, and the upper hinge bracket and the lower hinge bracket keep the door attached to the frame of the domestic kitchen appliance when the upper hinge bracket, the lower hinge bracket and the door are in the door removal position.

BRIEF DESCRIPTION OF THE DRAWINGS

The following figures form part of the present specification and are included to further demonstrate certain aspects of the disclosed features and functions, and should not be used to limit or define the disclosed features and functions. Consequently, a more complete understanding of the exemplary embodiments and further features and advantages thereof may be acquired by referring to the following description taken in conjunction with the accompanying drawings, wherein.

DETAILED DESCRIPTION

The invention is described herein with reference to the accompanying drawings in which exemplary embodiments of the invention are shown. The invention may, however, be embodied in many different forms and should not be construed as limited to the embodiments set forth herein.

Figure 1:
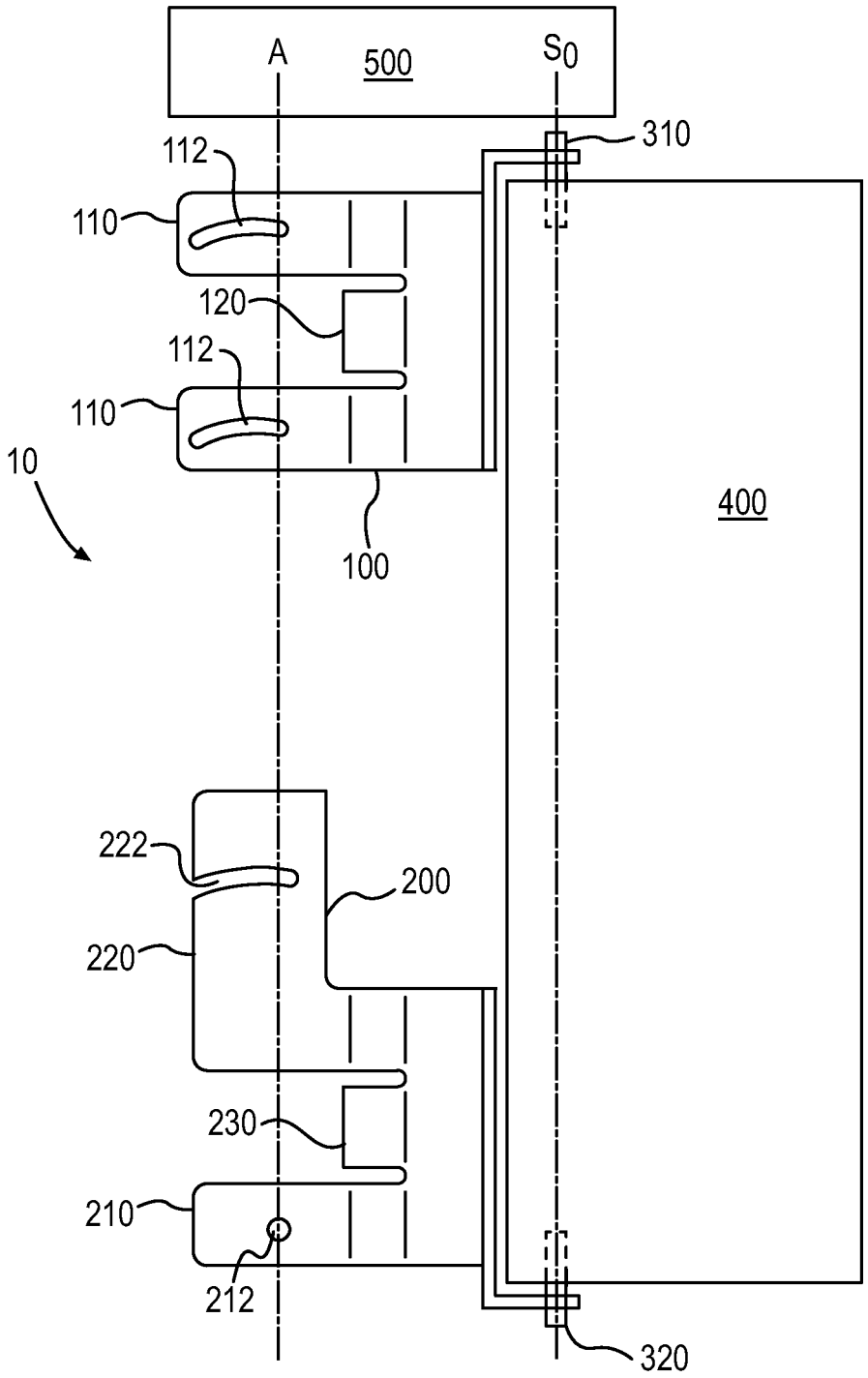
FIG. 1 is a side view of upper and lower hinge brackets in accordance with an exemplary embodiment of the invention.
Figure 9:
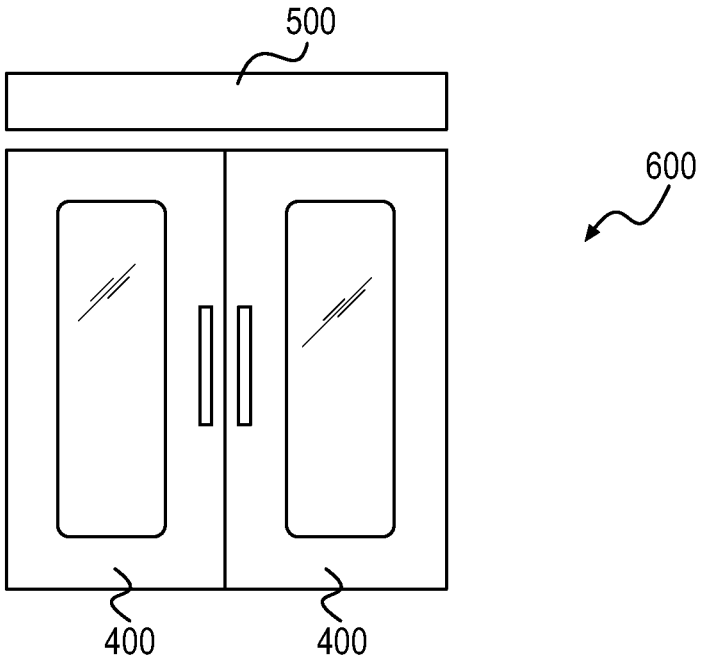
FIG. 9 is a schematic front view of an example of an appliance in accordance with an exemplary embodiment of the invention.
Figure 10:
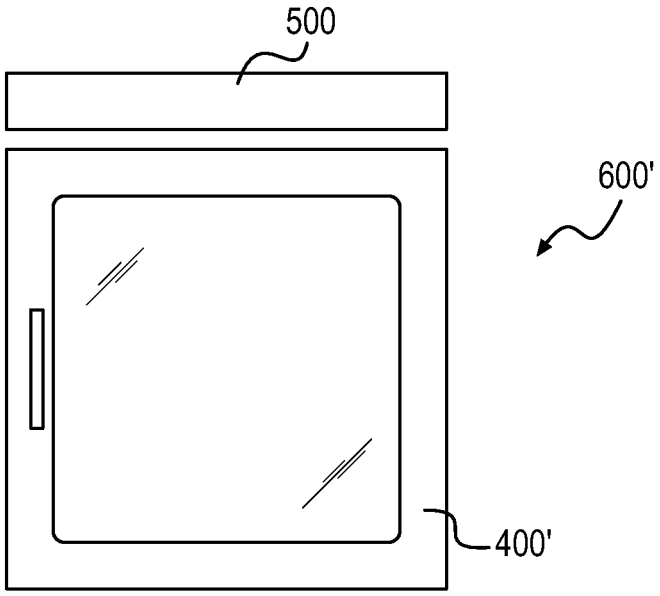
FIG. 10 is a schematic front view of an example of an appliance in accordance with an exemplary embodiment of the invention.

FIGS. 1, 9 and 10 show examples of a hinge assembly 10 in accordance with an embodiment of the invention. Hinge assembly 10 includes an upper hinge bracket 100 and a lower hinge bracket 200. Upper hinge bracket 100 is attached to a door 400 by a hinge pin 310. Lower hinge bracket 200 is attached to door 400 by a hinge pin 320. Pins 310 and 320 can be any suitable pivoting attachment mechanism. In this example, door 400, 400' is a side swing door of a domestic kitchen oven 600, 600' and swings about a swing axis $S_0$. Upper hinge bracket 100 and lower hinge bracket 200 are attached to a frame or other structural part of the oven so as to attach door 400 to the oven. A control panel 500 of the oven located in close proximity to the top of door 400.

In some ovens, a side swing door is removed by pulling its hinge pin up and out of the top of the door, which releases the door so that it can be removed. However, in the case of built-in ovens it can be difficult or even impossible to remove the hinge pin without removing the oven from the cabinet or wall in which it is built. This is often due to the close proximity of the control panel over the top of the hinge pin. Due to the weight and size of a built-in oven, it can be difficult or even dangerous to remove the entire oven. The oven removal procedure can also require two people, which adds to the expense of such an operation.

The invention solves this problem by providing a hinge assembly that safely allows the door to be tilted away from the oven so that the hinge pin can be removed.

FIG. 1 shows upper hinge bracket 100 having two extensions 110, each of which has a radiused slot (or upper hinge pivot limiting element) 112. Upper hinge bracket 100 can be attached to the frame of the oven by, for example, shoulder bolts (or frame pivot limiting elements) passing through slots 112. Lower hinge bracket 200 is shown with an extension 210 having a hole 212, and an extension 220 having a radiused slot 222. Lower hinge bracket 200 can be attached to the frame of the oven by, for example, shoulder bolts passing through hole 212 and slot 222. The shoulder bolt passing through hole 212 can be considered a frame pivot element. By using shoulder bolts, upper hinge bracket 100 and lower hinge bracket 200 are restrained in a direction perpendicular to the paper in FIG. 1, but are allowed to pivot about hole (or system pivot element) 212. When the door is in the operating position, swing axis $S_0$ is vertical or at least substantially vertical. FIG. 1 shows a line A drawn through slots 112, slot 222 and hole 212. Line A represents an alignment of one possible position of the shoulder bolts that attach upper hinge bracket 100 and upper hinge bracket 200 to the oven. In particular embodiments, line A is parallel to swing axis $S_0$. However, the shoulder bolts do not have to be aligned to function properly. The pivoting action of the hinge assembly will be described in more detail below.

Figure 2:
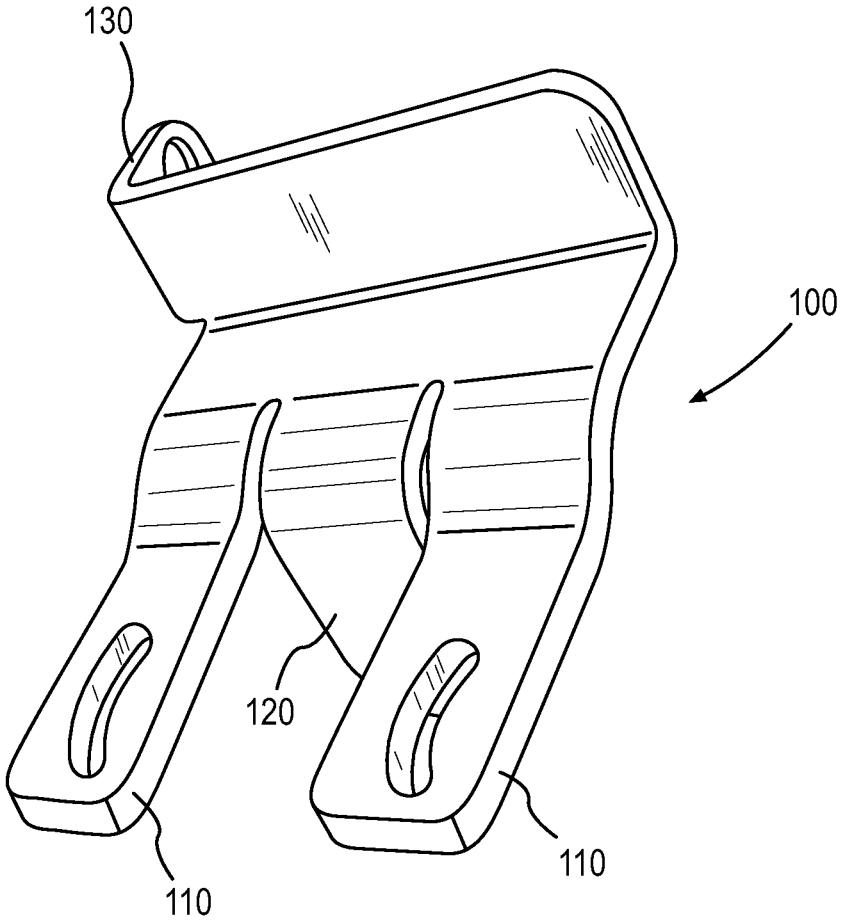
FIG. 2 is a perspective view of an example of an upper hinge bracket in accordance with an exemplary embodiment of the invention.
Figure 3:
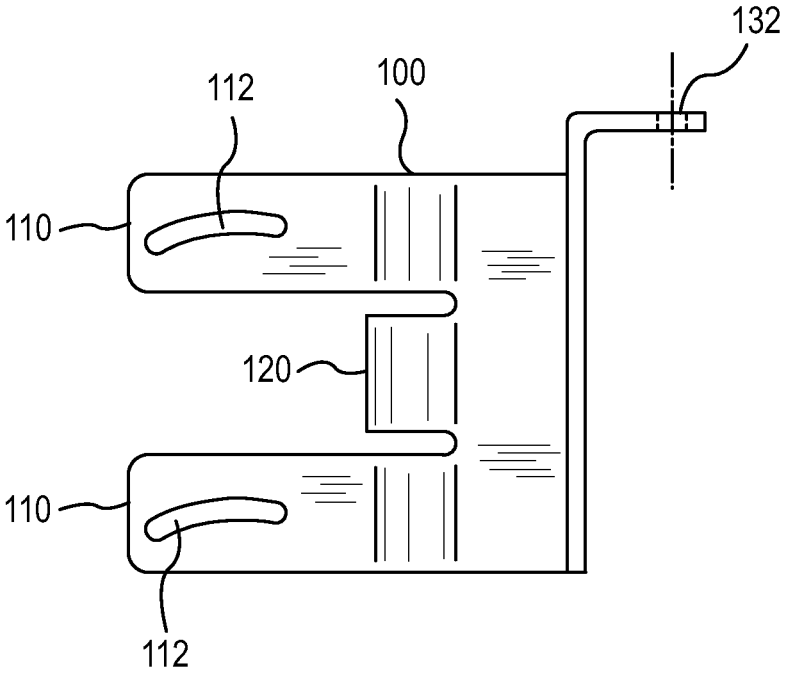
FIG. 3 is a side view of the upper hinge bracket of FIG. 2.
Figure 4:
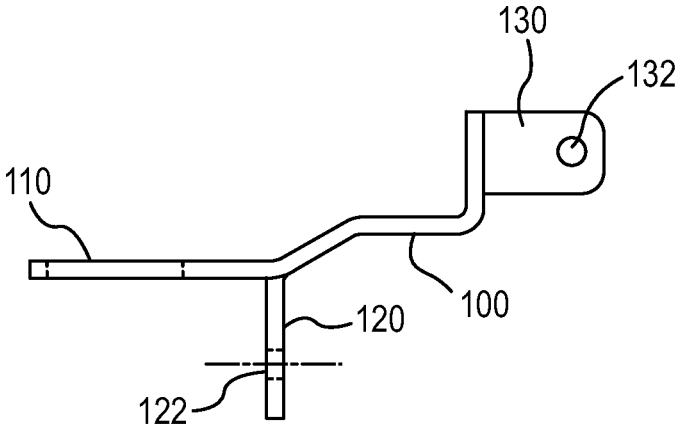
FIG. 4 is bottom view of the upper hinge bracket of FIG. 2.

FIGS. 2-4 show an example of upper hinge bracket 100 in more detail. A tab (or upper hinge swing element) 130 extends from upper hinge bracket 100 and is provided with a hole 132. In the operating position, pin (or door upper swing element) 310 passes through hole 132 and into the top of door 400, providing the upper swing point of door 400. Upper hinge bracket 100 also has a tab 120 that extends, in this example, perpendicularly to the plane of extensions 110. Tab 120 has a hole 122 through which a fastener can pass to connect upper hinge bracket 100 to the oven when the door is in the operating position. In the case of the fastener being a screw, the screw is screwed into the face of the oven to fix upper hinge bracket 100 securely in place.

Figure 5:
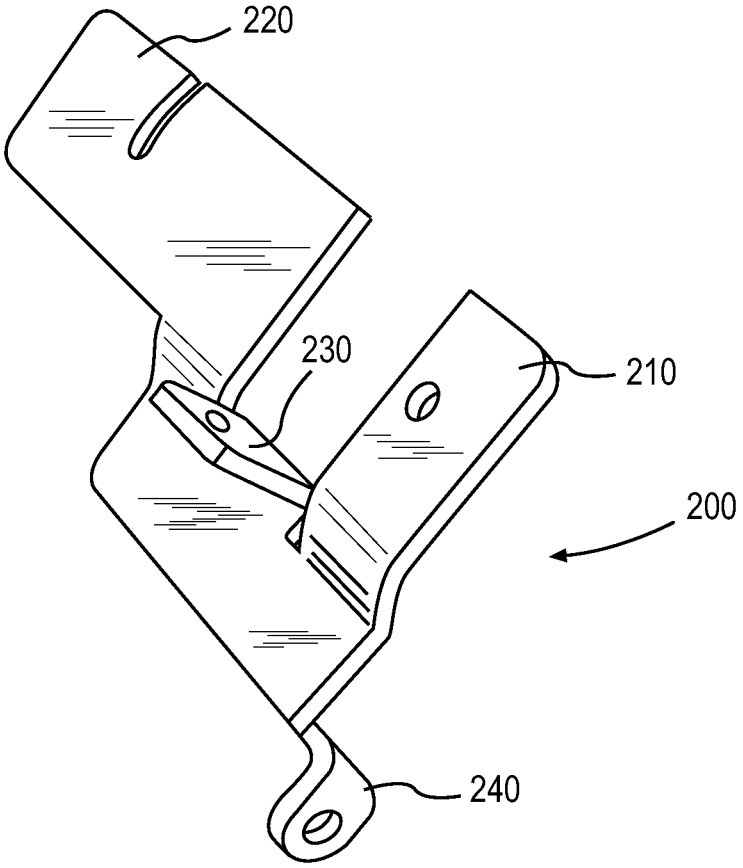
FIG. 5 is a perspective view of an example of a lower hinge bracket in accordance with an exemplary embodiment of the invention.
Figure 6:
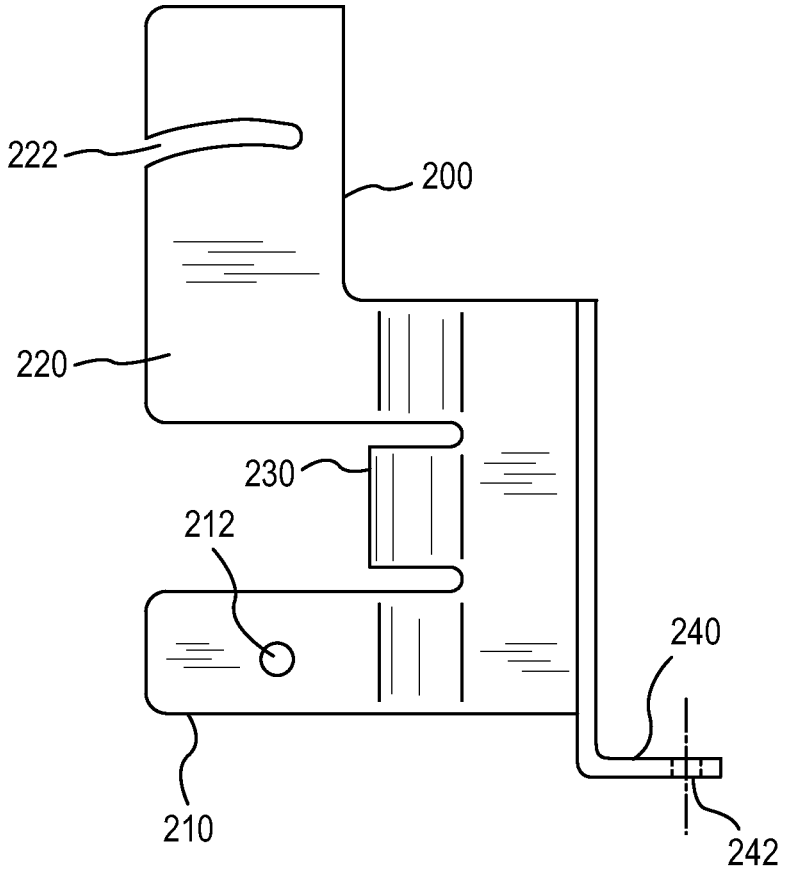
FIG. 6 is a side view of the lower hinge bracket of FIG. 5.
Figure 7:
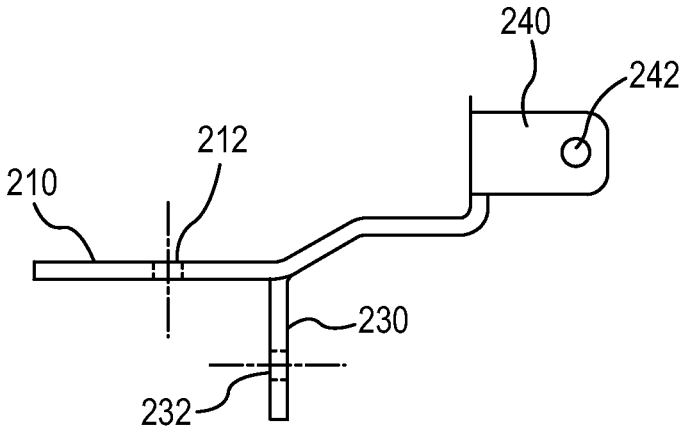
FIG. 7 is bottom view of the lower hinge bracket of FIG. 5.

FIGS. 5-7 show an example of lower hinge bracket 200 in more detail. A tab (or lower hinge swing element) 240 extends from lower hinge bracket 200 and is provided with a hole 242. In the operating position, pin (or door lower swing element) 320 passes through hole 242 and into the bottom of door 400, providing the lower swing point of door 400. Lower hinge bracket 200 also has a tab 230 that extends, in this example, perpendicularly to the plane of extensions 210, 220. Tab 230 has a hole 232 through which a fastener can pass to connect lower hinge bracket 200 to the oven when the door is in the operating position. In the case of the fastener being a screw, the screw is screwed into the face of the oven to fix lower hinge bracket 200 securely in place.

Figure 8:
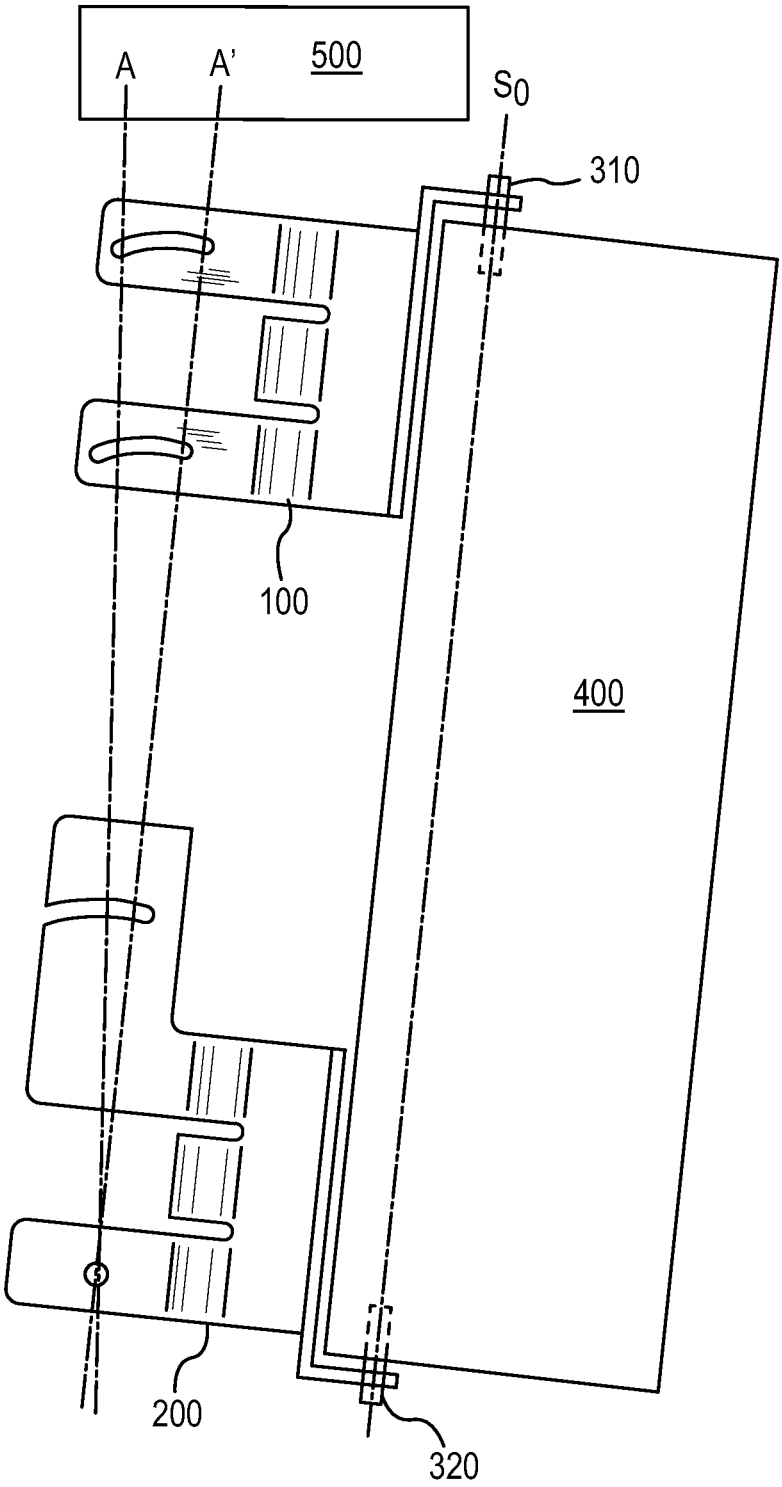
FIG. 8 is a side view of the upper and lower hinge brackets shown in FIG. 1 in a door removal position.

The operation of the hinge assembly will now be explained with reference to FIGS. 1 and 8. FIG. 1 shows door 400 in the operating position, where swing axis $S_0$ is parallel to line A. In the operating position, a fastener fixes upper hinge bracket 100 to the oven by way of tab 120. A second fastener can be used to fix lower hinge bracket 200 to the oven by way of tab 230. To remove door 400, door 400 is first opened to expose the fasteners passing through tabs 120 and 230. The fastener (if any) in tab 230 is first removed. Then, the fastener in tab 120 is removed. Removal of the fastener in tab 120 allows door 400, upper hinge bracket 100, and lower hinge bracket 200 to pivot about hole 212 such that the top of door 400 pivots outward to a door removal position. FIG. 8 shows door 400, upper hinge bracket 100, and lower hinge bracket 200 in the door removal position. In this position, swing axis $S_0$ is no longer vertical. In this example, the shoulder bolts located in slots 112, slot 222 and hole 212 remain attached to the oven and aligned along line A. Line A' represents the position of the shoulder bolts relative to the brackets when door 400, upper hinge bracket 100, and lower hinge bracket 200 were in the operating position. Slots 112 and slot 222 slide along the shoulder bolts as door 400, upper hinge bracket 100, and lower hinge bracket 200 pivot from the operating position to the door removal position.

Door 400, upper hinge bracket 100, and lower hinge bracket 200 are held in the door removal position (shown in FIG. 8) by one of or both slots 112 resting against a shoulder bolt. This contact between one of or both slots 112 and a shoulder bolt limits the travel of door 400, upper hinge bracket 100, and lower hinge bracket 200 in the pivoting direction. With door 400, upper hinge bracket 100, and lower hinge bracket 200 being held in the door removal position, hinge pin 310 can be pulled up and out of door 400, allowing door 400 to be tilted away from upper hinge bracket 100, lifted off of hinge pin 320, and removed from the oven.

In particular embodiments, the fastener used to secure tab 120 to the oven can be long enough to allow door 400, upper hinge bracket 100, and lower hinge bracket 200 to pivot sufficiently for removal of pin 310 while still holding upper bracket 100. If, for example, the fastener used to secure tab 120 is a bolt, the bolt can be unscrewed sufficiently to allow door 400, upper hinge bracket 100, and lower hinge bracket 200 to pivot far enough to remove pin 310 without releasing upper bracket 100 completely. This can provide a more controlled removal of door 400 by limiting the skewing of upper hinge bracket 100 relative to the shoulder bolts. This can also simplify reattachment of the door by keeping upper hinge bracket 100 in substantially the same position as when door 400 was removed.

Although embodiments of the invention have been described with reference to a domestic kitchen oven, it is noted that the invention can be applied to any side swing door, such as, for example, a refrigerator, a washer, or a dryer.

It will be appreciated that variants of the above-disclosed and other features and functions, or alternatives thereof, may be combined into many other different systems or applications. Various presently unforeseen or unanticipated alternatives, modifications, variations or improvements therein may be subsequently made by those skilled in the art which are also intended to be encompassed by the invention.

What is claimed is:

1. A hinge system for mounting a side swing door of a domestic kitchen appliance to a frame of the domestic kitchen appliance, the system comprising:

an upper hinge bracket having an upper hinge swing element configured to engage a door upper swing element fixed to the door of the domestic kitchen appliance, the engagement of the upper hinge swing element and the door upper swing element allowing the door to swing about a vertical axis between an open position and a closed position, and an upper hinge pivot limiting element configured to engage a frame pivot limiting element fixed to the frame of the domestic home appliance;

a lower hinge bracket having a lower hinge swing element configured to engage a door lower swing element, the engagement of the lower hinge swing element and the door lower swing element allowing the door to swing about the vertical axis between the open position and the closed position, and a system pivot element configured to engage a frame pivot element such that the upper hinge bracket, the lower hinge bracket, and the door are pivotable about a horizontal axis as a unit relative to the frame of the domestic kitchen appliance between an appliance operational position and a door removal position; and an operational position holding element attached to the upper hinge bracket or the lower hinge bracket, the operational position holding element configured to releasably hold the door in the appliance operational position, wherein the appliance operational position is a position of the upper hinge bracket, the lower hinge bracket, and the door at which the domestic kitchen appliance can be operated, and the upper hinge bracket and the lower hinge bracket are configured to keep the door attached to the frame of the domestic kitchen appliance when the upper hinge bracket, the lower hinge bracket and the door are in the door removal position.

2. The system of claim 1, wherein the upper hinge swing element is a hole and the door upper swing element is a pin.

3. The system of claim 2, wherein the lower hinge swing element is a hole or a recess and the door lower swing element is a pin.

4. The system of claim 1, wherein the lower hinge swing element is a pin and the door lower swing element is a hole or recess.

5. The system of claim 1, wherein the upper hinge pivot limiting element is a slot and the frame pivot limiting element is a bolt.

6. The system of claim 5, wherein the slot is a radiused slot having a constant radius relative to the horizontal axis.

7. The system of claim 5, wherein the slot is closed at a pivot limiting end and configured to hold the door in the door removal position by the frame pivot limiting element contacting the pivot limiting end of the slot.

8. The system of claim 1, wherein the system pivot element is a hole and the frame pivot element is a bolt.

9. The system of claim 1, wherein the operational position holding element is a tab, the tab having a hole configured to receive a fastener that holds the tab in a fixed position relative to the frame of the domestic kitchen appliance when the door is in the operational position.

10. The system of claim 1, wherein the upper hinge bracket further comprises a second upper hinge pivot limiting element configured to engage a second frame pivot limiting element fixed to the frame of the domestic home appliance.

11. The system of claim 1, wherein the upper hinge bracket and the lower hinge bracket are configured to be attached to the frame of the domestic kitchen appliance when the upper hinge bracket, the lower hinge bracket and the door are in the door removal position, such that the door is held in the door removal position by the upper hinge bracket and the lower hinge bracket.

12. A domestic kitchen appliance having a cavity for receiving food to be processed by the domestic kitchen appliance, the domestic kitchen appliance comprising:

a frame having a frame pivot limiting element and a frame pivot element;

a side swing door for selectively opening or closing the cavity, the door having a door upper swing element and a door lower swing element;

a hinge system mounting the door to the frame of the domestic kitchen appliance, the hinge system having an upper hinge bracket having an upper hinge swing element engaging the door upper swing element, the engagement of the upper hinge swing element and the door upper swing element allowing the door to swing about a vertical axis between an open position and a closed position, and an upper hinge pivot limiting element engaging the frame pivot limiting element;

a lower hinge bracket having a lower hinge swing element engaging the door lower swing element, the engagement of the lower hinge swing element and the door lower swing element allowing the door to swing about the vertical axis between the open position and the closed position, and a system pivot element engaging the frame pivot element such that the upper hinge bracket, the lower hinge bracket, and the door are pivotable about a horizontal axis as a unit relative to the frame of the domestic kitchen appliance between an appliance operational position and a door removal position; and an operational position holding element attached to the upper hinge bracket or the lower hinge bracket, the operational position holding element releasably holding the door in the appliance operational position, wherein the appliance operational position is a position of the upper hinge bracket, the lower hinge bracket, and the door at which the domestic kitchen appliance can be operated, and the upper hinge bracket and the lower hinge bracket keep the door attached to the frame of the domestic kitchen appliance when the upper hinge bracket, the lower hinge bracket and the door are in the door removal position.

13. The domestic kitchen appliance of claim 12, wherein the upper hinge swing element is a hole and the door upper swing element is a pin.

14. The domestic kitchen appliance of claim 13, wherein the pin is removable from the door such that removing the pin from the door allows the door to move relative to the upper hinge swing element.

15. The domestic kitchen appliance of claim 13, wherein the lower hinge swing element is a hole or a recess and the door lower swing element is a pin.

16. The domestic kitchen appliance of claim 12, wherein the upper hinge pivot limiting element is a slot and the frame pivot limiting element is a bolt.

17. The domestic kitchen appliance of claim 16, wherein the slot is a radiused slot having a constant radius relative to the horizontal axis.

18. The domestic kitchen appliance of claim 16, wherein the slot is closed at a pivot limiting end and configured to hold the door in the door removal position by the frame pivot limiting element contacting the pivot limiting end of the slot.

19. The domestic kitchen appliance of claim 12, wherein the system pivot element is a hole and the frame pivot element is a bolt.

20. The domestic kitchen appliance of claim 12, wherein the operational position holding element is a tab, the tab having a hole configured to receive a fastener that holds the tab in a fixed position relative to the frame of the domestic kitchen appliance when the door is in the operational position.

21. The domestic kitchen appliance of claim 12, wherein the upper hinge bracket further comprises a second upper hinge pivot limiting element configured to engage a second frame pivot limiting element fixed to the frame of the domestic home appliance.

22. The domestic kitchen appliance of claim 12, wherein the upper hinge bracket and the lower hinge bracket are attached to the frame of the domestic kitchen appliance when the upper hinge bracket, the lower hinge bracket and the door are in the door removal position, such that the door is held in the door removal position by the upper hinge bracket and the lower hinge bracket.

* * * * *